US010214042B2

(12) United States Patent
McAlpine et al.

(10) Patent No.: US 10,214,042 B2
(45) Date of Patent: Feb. 26, 2019

(54) THERMAL TRANSFER PRINTING

(71) Applicant: Illinois Tool Works Inc., Glenview, IL (US)

(72) Inventors: Morven McAlpine, Ipswich (GB); Christopher Bennett, Brantham (GB)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 15/873,432

(22) Filed: Jan. 17, 2018

(65) Prior Publication Data

US 2018/0134058 A1 May 17, 2018

Related U.S. Application Data

(63) Continuation of application No. 12/919,785, filed as application No. PCT/GB2009/050169 on Feb. 20, 2009, now Pat. No. 9,873,278.

(30) Foreign Application Priority Data

Feb. 29, 2008 (GB) ..... 0803760.8

(51) Int. Cl.
*B41M 5/52* (2006.01)

(52) U.S. Cl.
CPC ..... *B41M 5/5218* (2013.01); *B41M 2205/02* (2013.01)

(58) Field of Classification Search
CPC ... B41M 5/05; B41M 5/5218; B41M 2205/02
(Continued)

(56) References Cited

U.S. PATENT DOCUMENTS 5,260,256 A * 11/1993 Takahara et al. ..... B41M 5/035 503/227
5,644,350 A 7/1997 Ando et al.
(Continued)

FOREIGN PATENT DOCUMENTS

DE 19639167 4/1997
EP 0 474 355 3/1992
(Continued)

OTHER PUBLICATIONS

International Search Report from PCT/GB2009/050169 dated Apr. 2, 2009 (3 pages).
(Continued)

*Primary Examiner* — Bruce H Hess
(74) *Attorney, Agent, or Firm* — Neal, Gerber & Eisenberg LLP

(57) ABSTRACT

Disclosed is a tool for driving a barbed staple into a workpiece, the tool includes a housing enclosing a power delivery source and a driver blade driven by the power delivery source and comprising an engagement portion configured for engagement with the staple. The tool further includes a nosepiece comprising an aperture providing access for loading a staple into the nosepiece and a passage configured for slidable mounting of the driver blade. In use, the driver blade may be driven along a longitudinal axis of the passage by the power delivery source to engage and drive a staple into a workpiece. Clearances are providing to allow for loading and passage of the barbed staples in the nosepiece and arrangements are provided to maintain the alignment of the staple in the nosepiece to compensate for those clearances.

24 Claims, 5 Drawing Sheets

(58) Field of Classification Search
USPC ..... 503/227
See application file for complete search history.

(56) References Cited

U.S. PATENT DOCUMENTS

| | | | |
|---|---|---|---|
| 2003/0099815 | A1 | 5/2003 | Dontula et al. |
| 2005/0134656 | A1 | 6/2005 | Gao |
| 2007/0212527 | A1 | 9/2007 | Dontula et al. |

FOREIGN PATENT DOCUMENTS

| | | |
|---|---|---|
| EP | 0 628 421 | 12/1994 |
| GB | 2 364 707 | 2/2002 |
| JP | S62-297184 | 12/1987 |
| JP | H6-8660 | 1/1994 |
| JP | 410114156 | 5/1998 |
| JP | 2001080223 | 3/2001 |

OTHER PUBLICATIONS

Written Opinion from PCT/GB2009/050169 dated Apr. 2, 2009 (6 pages).
UK Search Report from GB0803760.8 dated Apr. 8, 2008 (5 pages).

* cited by examiner

THERMAL TRANSFER PRINTING

PRIORITY CLAIM

This patent application is a continuation of, and claims priority to and the benefit of, U.S. patent application Ser. No. 12/919,785, which was filed on Aug. 27, 2010, which is a national stage entry of PCT Application No. PCT/GB2009/050169, which was filed on Feb. 20, 2009, which claims priority to and the benefit of Great Britain Application No. 0803760.8, which was filed on Feb. 29, 2008, the entire contents of each of which are incorporated herein by reference.

TECHNICAL FIELD

The present invention relates to a receiver layer, preferably thermally transferable, for use in dye diffusion thermal transfer printing, and a thermal transfer ribbon comprising such a receiver layer.

BACKGROUND

Dye diffusion thermal transfer printing is a well known process in which one or more thermally transferable dyes are transferred from selected areas of a dyesheet to a receiver material by localised application of heat, thereby to form an image. Full colour images can be produced in this way using dyes of the three primary colours, yellow, magenta and cyan. Printing is conveniently carried out using a dyesheet in the form of an elongate strip or ribbon of a heat-resistant substrate, typically polyethylene terephthalate polyester film, carrying a plurality of similar sets of different coloured dye coats, each set comprising a panel of each dye colour (e.g. yellow, magenta and cyan plus optional black), with the panels being in the form of discrete stripes extending transverse to the length of the ribbon, and arranged in a repeated sequence along the length of the ribbon.

Dye diffusion thermal transfer printing may be used to print directly onto a variety of substrates, for example onto PVC. However some substrates, e.g. polycarbonate, certain polyesters and ABS, are not sufficiently dye receptive for good quality images to be formed by printing onto them directly.

This problem is well-known and one known solution is to apply a dye-receptive coating, also called a receiver layer, during manufacture of the substrate.

In order for such coatings to adhere to the substrate they must be sufficiently adhesive. However, as dye diffusion thermal transfer printing involves the physical contact of the printing ribbon with the substrate to be printed on, this can create difficulties with excessive ribbon release force or even ribbon sticking.

To overcome this problem such coatings are typically curable so that their adhesive nature is reduced during cross-linking without the risk of the coating detaching from the substrate. To further reduce the risk of ribbon adhesion it is known to incorporate in the coating so-called release agents, e.g. silicone oil. However, often only a small region of the substrate is to be printed on and so coating the substrate during its manufacture can involve unnecessary costs.

An alternative solution is to transfer a receiver layer to the substrate by the application of heat. Often this involves the thermal transfer of a dyable resin with excellent adhesive properties in order that it adheres to the substrate. In this case, the receiver layer is typically not cured as curing during the coating process, i.e. prior to transfer, would hinder or prevent the transfer of the receiver layer onto the substrate. To reduce ribbon release force upon subsequent printing, release agents may be used but this often provides an insufficient reduction in the ribbon release force and problems of ribbon sticking are not eliminated, particularly where a receiver layer having excellent adhesion is used.

As a solution to this problem it has been suggested to thermally transfer two or even three layers. For example an arrangement involving an adhesive layer followed by an image-receiving layer and an uppermost release layer has been proposed in EP 0474355.

SUMMARY OF THE INVENTION

In a first aspect, the invention provides a receiver layer for use in dye diffusion thermal transfer printing comprising a release agent and a swellable inorganic lamellar material that is at least partially in an intercalated or exfoliated state.

It has been observed by the present inventors that the ribbon release force increases as successive colour panels are printed onto substrates having a receiver layer. Whilst the ribbon release force might be acceptable when printing the first colour panel (e.g. yellow) or even the subsequent colour panel (e.g. magenta), it has been found that the release force for subsequent panels, particularly for uncured receiver layers, becomes too high.

The increase in release force as printing proceeds is believed to be due to release agent being drawn out, or "clawed back", of the receiver layer during printing. Thus, whilst there may be sufficient release agent during the first colour print, loss of release agent may result in adhesion of the ribbon to the receiver layer during subsequent colour prints.

Preferably the receiver layer is thermally transferable.

The present invention involves the use of inorganic lamellar material which is at least partially in an intercalated or exfoliated state. Material in this state is believed to create a tortuous path within the receiver layer, hindering the movement of the release agent molecules, thus reducing the amount of release agent claw-back during printing.

This enables a receiver layer, preferably thermally transferable, to be produced which has excellent adhesion, is dye receptive and has acceptable release properties in one layer. Achieving these properties in one layer allows them to be made more simply and at reduced cost.

Before application to the substrate, the receiver layer is typically coated onto a base film such that it can be transferred onto a substrate e.g. by means of a thermal print head or by pressing through hot rollers. The receiver layer may be coated as a continuous length on the base film prior to printing or alternatively it may be coated from a panel as part of a panelled dye-sheet including, for example, yellow, magenta, cyan, black and overlay panels.

The inorganic material is typically a clay and is preferably at least partially in an exfoliated state.

The inorganic lamellar materials, e.g. clays, used in the present invention are structurally different to traditional macrocomposites (see FIG. 1). The inorganic lamellar materials involve polymer material expanding the platelets in a macrocomposite to cause swelling due to the polymer molecules entering between the platelets to create an intercalated nonocompsite. This may be followed by further disruption of the ordering of the platelets to result in platelets dispersed within a polymer material, also known as an exfoliated nanocomposite. It is this dispersion and lack of order of the platelets which is believed to create the tortuous path within the receiver layer.

It is preferred that when the inorganic lamellar material is a clay it is an organically modified clay such as organically modified montmorillonite smectite clays. However non-organically modified clays could be used in certain circumstances, for example if water were used as the swelling agent in combination with a water soluble polymer.

Organic modification can increase the affinity between the polymer and the lamellar material. A preferred organic modifier is based on an ammonium ion with functional groups attached, selected according to the to the polymer material used to swell the lamellar material. Such functional groups may suitably be long chain alkyl groups, hydroxyl groups, aromatic rings or just hydrogens. Organic modification can be carried out by using an ion exchange process between the lamellar material and an organic modifier. This method can also be used, e.g. to add polymerisable groups onto the lamellar material so that the polymer can be reacted onto the lamellar particles.

Disruption of the lamellar material macrocomposite structure by use of a polymer can be achieved in a number of ways, and these methods will be known to a person skilled in the art. For example the solvent (or solution) method, the melt-blending method and the in-situ polymerisation method are all suitable. The solvent (or solution) method is currently preferred.

Typically, the receiver layers of the present invention have a thickness of from 0.5 to 5.0 microns, preferably from 1.5 to 3.5 microns.

It has been found that an increase in the amount of inorganic lamellar material gives a corresponding decrease in the ribbon release force, however too high a level of clay can reduce the ability of a dye to diffuse into the receiver layer and can reduce the optical density of resulting prints. Preferably the partially exfoliated or intercalated material is present in the receiver layer at a level of from 0.5 to 8.0 wt %, more preferably at a level of from 1.0 to 5.0 wt %.

Examples of suitable release agents include silicones, phosphoric acid ester surfactants, fluorine surfactants, higher fatty acid esters and fluorine compounds. The release agent may be included in the receiver layer at a level of from 1.0 to 10 wt %, preferably from 1.0 to 5.0 wt %.

Preferably the receiver layer comprises a resin, and which desirably has excellent transfer and adhesion properties. The resin may comprise polyester, acrylic, vinyl chloride, vinyl acetates or mixtures thereof. However preferably, the resin comprises a polyester and more preferably having a molecular weight in the range of from 6000 to 10000. If present, the resin may comprise from 70 to 99.5 wt % of the receiver layer, preferably from 80 to 99 wt %, more preferably from 90 to 99 wt %.

BRIEF DESCRIPTION OF THE DRAWINGS

The invention will now be illustrated with reference to the following figures, in which.

DETAILED DESCRIPTION

EXAMPLES

Sample Preparation

Figure 1:
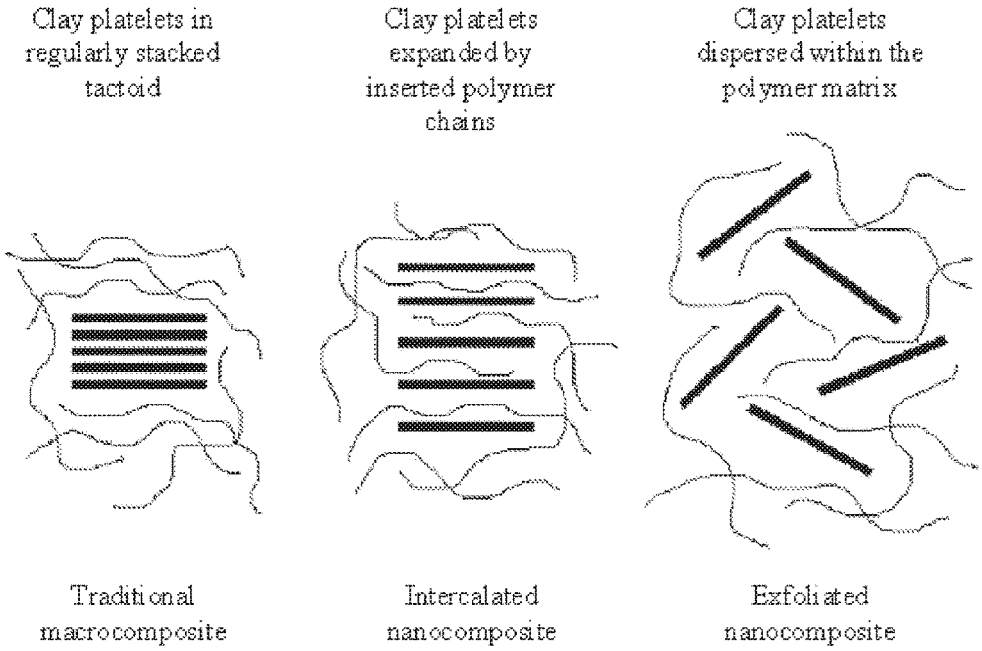
FIG. 1 is a schematic illustrating the structural differences between a traditional macrocomposite, an intercalated nanocomposite and an exfoliated nanocomposite.

The solvent (or solution) method of nanocomposite preparation is used wherein a solvent is selected in which the polymer is soluble and the clay is swellable. The clay is first swollen in a suitable solvent. The swollen clay and polymer solution are then mixed and the polymer chains intercalate into the clay gallery displacing the solvent molecules. The solvent is then removed and a polymer-clay nanocomposite is formed. The solvent aids the exfoliation process as it acts as a swelling agent, increasing the spacing between the clay platelets prior to mixing with the polymer. There is a loss of entropy of the polymer chains as they intercalate into the clay galleries. The driving force for this to occur is the entropy gained by de-sorption of the solvent molecules.

An increase in viscosity and a lack of opacity of the dispersed clay/solvent dispersion and a lack of any settling out of clay upon standing for 24 hours were used as signs of at least partial exfoliation of the clay. A release agent was added to the clay/solvent pre-dispersion followed by addition of a resin/solvent solution, form the coating solution. Again the samples were observed for any clay dropout over time. A lack of settling out of clay was used as an indication that the clay was remaining in an exfoliated state within the coating solution. A coating was applied by hand using a Meier bar to give a wet coat weight of ~12 μm, onto a 6 μm polyester base film. The base film was already coated with a heat resistant backcoat to provide protection from the thermal head during the printing process, and a cross-linked acrylic subcoat to provide release of the receiver during transfer. The coating was dried initially by a hair drier, then in an oven at 110° C. for 30 seconds.

Example 1

Three organically modified clays (Cloisites) obtained from Southern clay products were tested. These were all montmorillonite smectite clays that differed in their organic modification. The organic modifiers of the three Cloisites are given below.

Cloisite 15A™ modifier

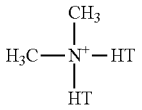

Cloisite 30B™ modifier

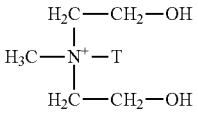

Cloisite 93A™ modifier

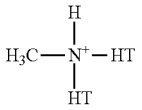

-continued

HT = Hydrogenated tallow (~65% C18, ~30% C16, ~5% C14)
T = Tallow (~65% C18, ~30% C16, ~5% C14)

A coating solution A (comparative) was prepared from:

| | |
|---|---|
| Cloisite 15A ™ Toluene pre-dispersion | 5% Cloisite wrt resin (1.6% wrt total weight) |
| Vylon 885 | 15.7% wrt total weight |
| MEK/Toluene 50/50 wt/wt | 82.7% wrt total weight |

A coating solution B (comparative) was prepared from:

| | |
|---|---|
| Tegoglide A115 ™ | 2% wrt resin (0.32% wrt total weight) |
| Vylon 885 ™ | 16% wrt total weight |
| MEK/Toluene 50/50 wt/wt | 83.7% wrt total weight |

A coating solution C (comparative) was prepared from:

| | |
|---|---|
| Tegoglide 410 ™ | 2% wrt resin (0.32% wrt total weight) |
| Vylon 885 ™ | 16% wrt total weight |
| MEK/Toluene 50/50 wt/wt | 83.7% wrt total weight |

A coating solution D (comparative) was prepared from:

| | |
|---|---|
| Tegoprotect 5000 ™ | 2% wrt resin (0.32% wrt total weight) |
| Vylon 885 | 16% wrt total weight |
| MEK/Toluene 50/50 wt/wt | 83.7% wrt total weight |

A coating solution E (comparative) was prepared from:

| | |
|---|---|
| Tegomer Csi2342 ™ | 2% wrt resin (0.32% wrt total weight) |
| Vylon 885 ™ | 16% wrt total weight |
| MEK/Toluene 50/50 wt/wt | 83.7% wrt total weight |

A coating solution F (comparative) was prepared from:

| | |
|---|---|
| Tegoglide 450 ™ | 2% wrt resin (0.32% wrt total weight) |
| Vylon 885 ™ | 16% wrt total weight |
| MEK/Toluene 50/50 wt/wt | 83.7% wrt total weight |

A coating solution G (according to the invention) was prepared from:

| | |
|---|---|
| Cloisite 15A/™ toluene pre-dispersion | 5% Cloisite wrt resin (1.6% wrt total weight) |
| Tegoglide A115 ™ | 2% wrt resin (0.32% wrt total weight) |
| Vylon 885 ™ | 15.7% wrt total weight |
| MEK/Toluene 50/50 wt/wt | 82.4% wrt total weight |

A coating solution H (according to the invention) was prepared from:

| | |
|---|---|
| Cloisite 15A/toluene pre-dispersion | 5% Cloisite wrt resin (1.6% wrt total weight) |
| Tegoglide 410 ™ | 2% wrt resin (0.32% wrt total weight) |
| Vylon 885 ™ | 15.7% wrt total weight |
| MEK/Toluene 50/50 wt/wt | 82.4% wrt total weight |

A coating solution I (according to the invention) was prepared from:

| | |
|---|---|
| Cloisite 15A/toluene pre-dispersion | 5% Cloisite wrt resin (1.6% wrt total weight) |
| Tegoprotect 5000 ™ | 2% wrt resin (0.32% wrt total weight) |
| Vylon 885 | 15.7% wrt total weight |
| MEK/Toluene 50/50 wt/wt | 82.4% wrt total weight |

A coating solution J (according to the invention) was prepared from:

| | |
|---|---|
| Cloisite 15A/™ toluene pre-dispersion | 5% Cloisite wrt resin (1.6% wrt total weight) |
| Tegomer Csi 2342 ™ | 2% wrt resin (0.32% wrt total weight) |
| Vylon 885 ™ | 15.7% wrt total weight |
| MEK/Toluene 50/50 wt/wt | 82.4% wrt total weight |

A coating solution K (accordina to the invention) was prepared from:

| | |
|---|---|
| Cloisite 15A/toluene pre-dispersion | 5% Cloisite wrt resin (1.6% wrt total weight) |
| Tegoglide 450 Tegoglide 450 | 2% wrt resin (0.32% wrt total weight) |
| Vylon 885 | 15.7% wrt total weight |
| MEK/Toluene 50/50 wt/wt | 82.4% wrt total weight |

A coating solution L (comparative) was prepared from:

| | |
|---|---|
| Cloisite 93A/toluene pre-dispersion | 5% Cloisite wrt resin (1.6% wrt total weight) |
| Tegoglide A115 | 2% wrt resin (0.32% wrt total weight) |
| Vylon 885 | 15.7% wrt total weight |
| MEK/Toluene 50/50 wt/wt | 82.4% wrt total weight |

A coating solution M (comparative) was prepared from:

| | |
|---|---|
| Cloisite 30B/toluene pre-dispersion | 5% Cloisite wrt resin (1.6% wrt total weight) |
| Tegoglide A115 | 2% wrt resin (0.32% wrt total weight) |
| Vylon 885 | 15.7% wrt total weight |
| MEK/Toluene 50/50 wt/wt | 82.4% wrt total weight |

Each of coatings B to F are for comparison with coatings G to K according to the invention.

Vylon 885™ is a polyester available from Toyubo. Tegoglide A115™ is an organo-modified polysiloxane. Tegoglide 410™ is a polyether siloxane copolymer. Tegoprotect 5000™ is a modified polydimethyl siloxane resin. Tegomer Csi 2342™ is a linear organo-functional polysiloxane. Tegoglide 450™ is a polyether siloxane copolymer. All Tego additives are available from Degussa.

Testing

The organo-clay dispersions were observed as described in the sample preparation section above.

TABLE 1

| Organo-clay | Appearance | Appearance after stirring in solvent | Appearance after addition of pre-dispersion to polymer/solvent solution |
|---|---|---|---|
| Cloisite 15A | Off-white solid | Clear, yellow viscous fluid | No drop out of any filler, clear fluid |
| Cloisite 93A | Off-white solid | Murky, low viscosity fluid | Cloudy, some drop out of solid material |
| Cloisite 30B | Off-white solid | Murky, low | Cloudy, large |

TABLE 1-continued

| Organo-clay | Appearance | Appearance after stirring in solvent | Appearance after addition of pre-dispersion to polymer/solvent solution |
|---|---|---|---|
| | | viscosity fluid | amount of drop out of material |

From the observations contained in table 1 Cloisite 15A was assigned as being in at least a partially exfoliated state, whereas Cloisite 93A and 30B were assigned as being in a non-exfoliated state i.e. like a traditional clay filler. This is not to say that Cloisite 93A, Cloisite 30B or any swellable layered silicate (modified or not) could not be used in the application as disclosed herein provided that the appropriate conditions and formulation were used i.e. a solvent in which the clay is swellable, use of a polymer solution in which the clay remains in an exfoliated state or use of a different method of achieving exfoliation e.g. in situ polymerisation.

The coatings were spliced into a dye-sheet and printed as a monochrome panel onto PVC and polycarbonate cards using a Pebble-3 printer (manufactured by Evolis). The receiver layer was visually assessed for transfer, looking for full coverage of the card and no flash (i.e. that the receiver layer gave a clean fracture along the edge of the printed area and there was no ragged torn edge to the panel). The receiver layer was print tested by printing a high-density coloured image (red lips image with black background) on a Pebble-3 printer using a standard YMCKO dye ribbon from ICI.

Cyan peel forces were measured by first printing yellow 255 using a thermal print head set up that does not remove the dye-sheet after printing. The printed yellow dye-sheet was manually removed and then the same card was printed with magenta 255. The magenta dye-sheet was removed manually and a cyan image consisting of increasing density bars was printed. The cyan dye-sheet was not removed at this stage. The cyan dye-sheet was peeled apart from the card using an Instron 6021. The maximum peel force recorded during the removal of the dye-sheet was noted and reported as the cyan peel force for that sample.

All examples above transferred well via heating with a thermal print head, there was complete transfer of all examples with no signs of flash. A table summarising the cyan peel force and print test results is given below. Using the methods as described in the sample preparation section described above it was concluded that the organo-clays contained within solutions L and M were not in an exfoliated state and therefore would not be expected to provide the beneficial barrier effect to reduce claw-back of the release agent. In the table TT stands for total transfer i.e. when parts of the ribbon have stuck to the card.

TABLE 2

| Coating solution | Cyan peel force (N) | Print test |
|---|---|---|
| A (comparative) | | Ribbon stuck when printing cyan |
| B (comparative) | 3.46 | Ribbon stuck at cyan |
| C (comparative) | 3.87 | Ribbon stuck at cyan |
| D (comparative) | 3.22 | Speckled cyan TT |
| E (comparative) | 3.13 | Ribbon stuck at cyan |
| F (comparative) | Stuck at magenta so couldn't measure cyan peel force | Ribbon stuck at magenta |
| G | 2.4 | Good image, no TT |
| H | 1.79 | Good image, no TT |
| I | 1.91 | Good image, no TT |
| J | 2.44 | Good image, no TT |
| K | 1.8 | Good image, no TT |
| L (comparative) | | Ribbon stuck at cyan |
| M (comparative) | | Ribbon stuck at cyan |

Figure 2:
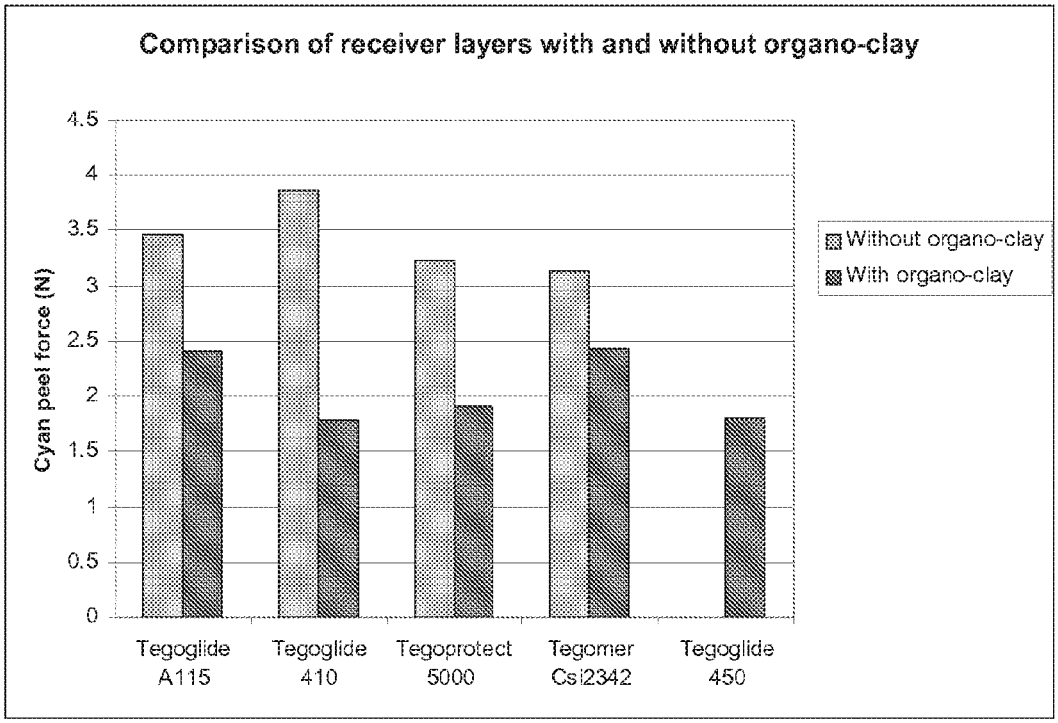
FIG. 2 is a chart showing the cyan peel force for receiver layers without clay (coatings B to E) and with clay (coatings G to K).

The cyan peel force results comparing resin+release agent receiver layers with resin+release agent+organo-clay receiver layers for coating solutions B to K are summarised in FIG. 2. Coating solution F has not been included as no value could be obtained for this sample due to the magenta ribbon sticking (could not be removed by manual peeling) before printing cyan.

It can be clearly seen that addition of an organo-clay to a receiver layer of a dyeable resin plus release agent reduces the cyan peel force and improves the dye diffusion print performance.

Example 2

Figure 3:
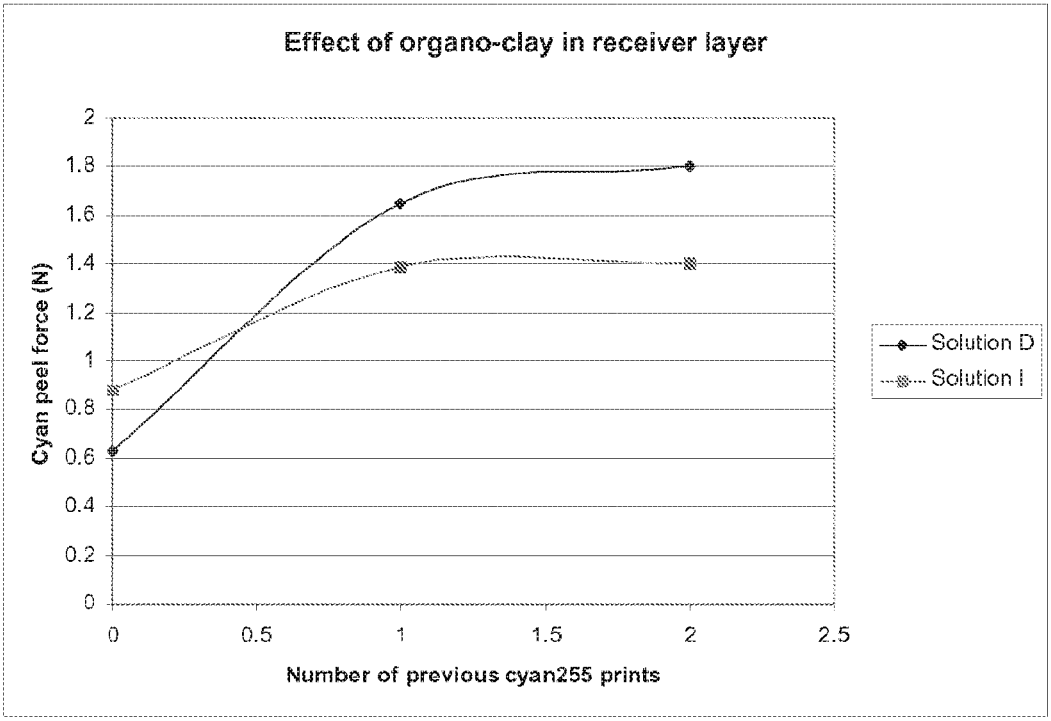
FIG. 3 is a chart showing the cyan peel force as a function of number of previous cyan 255 prints for a receiver layer without clay (coating D) and with clay (coating I).
Figure 4:
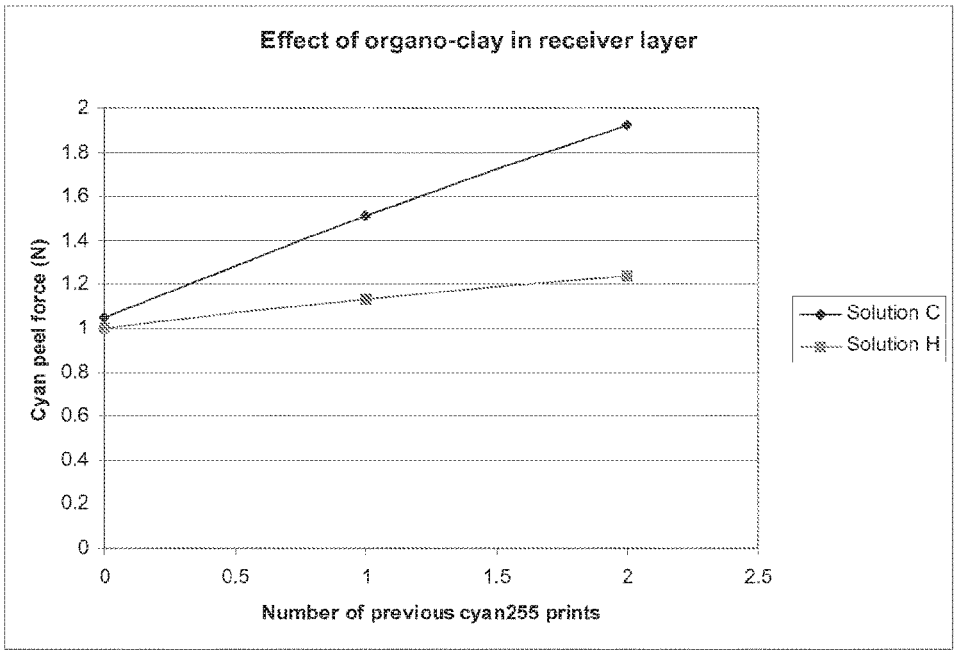
FIG. 4 is a chart showing the cyan peel force as a function of number of previous cyan 255 prints for a receiver layer without clay (coating C) and with clay (coating H).
Figure 5:
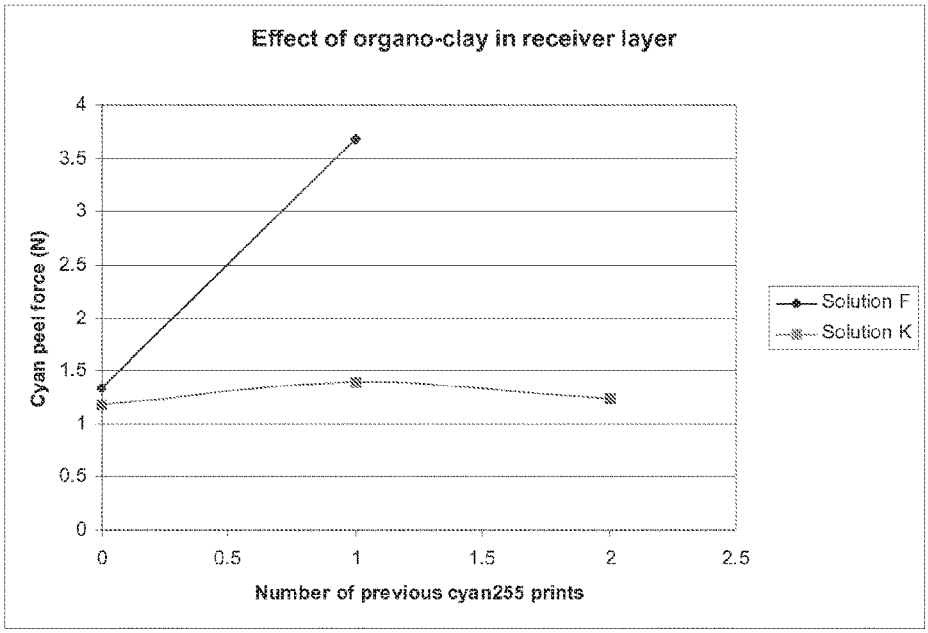
FIG. 5 is a chart showing the cyan peel force as a function of number of previous cyan 255 prints for a receiver layer without clay (coating F) and with clay (coating K).

Thermally transferable receiver layers were prepared and transferred as described in the sample preparation section described above. A standard YMCKO ribbon from ICI was used to print three samples as described below:

1) Increasing density cyan bars with no preceding print
2) One print of cyan 255, dye-sheet removed manually, followed by increasing density cyan bars
3) Two prints of cyan 255, dye-sheet removed manually, followed by increasing density cyan bars The cyan peel forces were measured as described in the testing section as described above. FIGS. 3 to 5 show the increase in cyan peel force with increasing number of preceding prints.

The invention claimed is:

1. A thermal transfer ribbon for use in dye diffusion thermal transfer printing, the thermal transfer ribbon comprising:

a continuous strip of a substrate having a thermally transferable receiver layer on one side surface of the substrate, the thermally transferable receiver layer comprising:

a release agent, and a swellable inorganic lamellar material that is at least partially in an exfoliated or intercalated state, wherein the thermally transferable receiver layer is positioned so that part of the thermally transferable receiver layer can be transferred from the substrate to a receiving substrate.

2. The thermal transfer ribbon of claim 1, wherein the swellable inorganic lamellar material is a clay.

3. The thermal transfer ribbon of claim 2, wherein the clay is at least partially in the exfoliated state.

4. The thermal transfer ribbon of claim 1, wherein the swellable inorganic lamellar material is organically modified.

5. The thermal transfer ribbon of claim 1, which comprises from 0.5 to 8.0 wt % of the swellable inorganic lamellar material.

6. The thermal transfer ribbon of claim 1, which comprises from 1.0 to 5.0 wt % of the swellable inorganic lamellar material.

7. The thermal transfer ribbon of claim 1, further comprising a polymer resin.

8. The thermal transfer ribbon of claim 7, which comprises from 70 to 99.5 wt % of the polymer resin.

9. The thermal transfer ribbon of claim 7, wherein the polymer resin comprises a polyester.

10. A ribbon set for use in dye diffusion thermal transfer printing, the ribbon set comprising:

a thermal transfer ribbon comprising a continuous strip of a substrate having a thermally transferable receiver layer on one side surface of the substrate, the thermally transferable receiver layer comprising:

a release agent, and a swellable inorganic lamellar material that is at least partially in an exfoliated or intercalated state, wherein the thermally transferable receiver layer is positioned so that part of the thermally transferable receiver layer can be transferred from the substrate to a receiving substrate; and one or more separate dye color ribbons each including one or more dyes that that can be transferred to the receiving substrate.

11. The ribbon set of claim 10, wherein the swellable inorganic lamellar material is a clay.

12. The ribbon set claim 11, wherein the clay is at least partially in the exfoliated state.

13. The ribbon set of claim 10, wherein the swellable inorganic lamellar material is organically modified.

14. The ribbon set of claim 13, which comprises from 0.5 to 8.0 wt % of the swellable inorganic lamellar material.

15. The ribbon set of claim 13, which comprises from 1.0 to 5.0 wt % of the swellable inorganic lamellar material.

16. The ribbon set of claim 10, wherein the thermal transfer ribbon further comprises a polymer resin.

17. The ribbon set of claim 16, which comprises from 70 to 99.5 wt % of the polymer resin.

18. The ribbon set of claim 16, wherein the polymer resin comprises a polyester.

19. A method of dye diffusion thermal transfer printing onto a receiving substrate, the method comprising the steps of:

thermally transferring part of a thermally transferable receiver layer from a thermal transfer ribbon onto a receiving substrate, the thermal transfer ribbon comprising a continuous strip of a substrate having the thermally transferable receiver layer on one side surface of the substrate, the thermally transferable receiver layer comprising:

a release agent, and a swellable inorganic lamellar material that is at least partially in an exfoliated or intercalated state; and subsequently transferring one or more dyes from one or more separate dye color ribbons onto the transferred receiver layer on the receiving substrate.

20. The method of claim 19, wherein the swellable inorganic lamellar material of the dye diffusion thermal transfer ribbon is a clay.

21. The method of claim 19, wherein the swellable inorganic lamellar material of the dye diffusion thermal transfer ribbon is organically modified.

22. The method of claim 19, wherein the thermal transfer ribbon further comprises a polymer resin.

23. The method of claim 22, wherein the polymer resin comprises a polyester.

24. The method of claim 22, wherein the receiver layer further comprises a polymer resin.

* * * * *